US007229389B2

(12) United States Patent
Hong

(10) Patent No.: US 7,229,389 B2
(45) Date of Patent: Jun. 12, 2007

(54) MULTIFUNCTION EXERCISER

(76) Inventor: Chou Hong, No. 17, Renhe Road, Nangang Industrial Zone, Nantou City, Nantou Hsien 54065 (TW)

( * ) Notice: Subject to any disclaimer, the term of this patent is extended or adjusted under 35 U.S.C. 154(b) by 211 days.

(21) Appl. No.: 11/141,964

(22) Filed: Jun. 1, 2005

(65) Prior Publication Data

US 2006/0276313 A1 Dec. 7, 2006

(51) Int. Cl.
*A63B 21/068* (2006.01)
*A63B 69/06* (2006.01)

(52) U.S. Cl. ..... 482/96; 482/72; 482/142; 482/145

(58) Field of Classification Search ..... 482/51, 482/72, 93–96, 142, 145, 907
See application file for complete search history.

(56) References Cited

U.S. PATENT DOCUMENTS 2,642,288 A * 6/1953 Bell ..... 482/96
2,924,456 A * 2/1960 Miller ..... 482/96
4,300,760 A * 11/1981 Bobroff ..... 482/96
5,366,428 A * 11/1994 Liao ..... 482/96
5,520,599 A * 5/1996 Chen ..... 482/96
5,527,243 A * 6/1996 Chen ..... 482/72
5,533,953 A * 7/1996 Lui et al. ..... 482/96
5,573,482 A * 11/1996 Wang et al. ..... 482/96
5,580,339 A 12/1996 Chen ..... 482/95
5,580,340 A 12/1996 Yu ..... 482/96
5,582,563 A * 12/1996 Fan ..... 482/96
5,584,785 A 12/1996 Wu ..... 482/95
5,643,147 A 7/1997 Huang ..... 482/72
5,674,161 A * 10/1997 Lin ..... 482/96
5,690,593 A * 11/1997 Huang ..... 482/96
6,135,930 A 10/2000 Kuo ..... 482/72
6,752,748 B1 * 6/2004 Scotti ..... 482/140

* cited by examiner

*Primary Examiner*—(Jackie) Tan-Uyen Ho
*Assistant Examiner*—Victor K. Hwang
(74) *Attorney, Agent, or Firm*—Charles E. Baxley

(57) ABSTRACT

A multifunction exerciser includes a base, a coupler rotatably attached to the base, a lever attached to the coupler and having one or more seats for supporting users, a handle device rotatably attached to the base, and a link pivotally coupling the handle device to the coupler and thus to the lever, to allow the user to elevate himself by rotating the handle device relative to the base. A foot support is rotatably attached to the base, and includes one or more foot pedals to support the user, and a connecting rod pivotally couples the foot support to the handle device and the coupler. The handle device includes a connecting bar coupled between two hand grips, and a connector rotatably coupled to the base.

6 Claims, 11 Drawing Sheets

MULTIFUNCTION EXERCISER

BACKGROUND OF THE INVENTION

1. Field of the Invention

The present invention relates to a multifunction exerciser, and more particularly to a multifunction exerciser for providing various kinds of operating modes and for allowing the users to conduct various kinds of exercising operations.

2. Description of the Prior Art

Various kinds of typical exercisers have been developed and provided for allowing the users to conduct various kinds of exercising operations, and some of the typical exercisers comprise a seat, a pair of foot pedals, and a handle device, coupled together, to allow the users to conduct pulling type or stepping type exercising operations.

For example, U.S. Pat. No. 5,580,339 to Chen discloses one of the typical exercisers including a structure for simulating horse riding exercises. However, the structure of the typical exerciser is arranged to allow the users to conduct and to simulate the horse riding exercises only, and may not be used to conduct the other type of exercising operations.

U.S. Pat. No. 5,580,340 to Yu discloses another typical exerciser including a structure for conducting stepping and/or pulling exercises. However, the structure of the typical exerciser is also arranged to allow the users to conduct and to simulate the stepping and/or pulling exercises only, and may not be used to conduct the other type of exercising operations.

U.S. Pat. No. 5,584,785 to Wu discloses a further typical exerciser including a structure for simulating horse riding exercises. However, similarly, the structure of the typical exerciser may also be used to conduct and to simulate the horse riding exercises only, and may not be used to conduct the other type of exercising operations.

U.S. Pat. No. 5,643,147 to Huang discloses a still further typical exerciser including a structure for conducting horse riding exercises, arm building exercises, chest building exercises, etc. However, additional cylinders or resistive devices that are normally expensive are required to be provided and coupled to the loading frame, in order to provide the resistive force against the loading frame.

U.S. Pat. No. 6,135,930 to Kuo discloses a still further typical exerciser including a foot support, and a handle device, and a seat back coupled together, to allow the users to conduct pulling type or stepping type or backing type exercising operations. However, similarly, additional cylinders or resistive devices that are normally expensive are required to be provided and coupled to the linking member, in order to provide the resistive force against the linking member.

The present invention has arisen to mitigate and/or obviate the afore-described disadvantages of the conventional exercising machines.

SUMMARY OF THE INVENTION

The primary objective of the present invention is to provide a multifunction exerciser for providing various kinds of operating modes and for allowing the users to conduct various kinds of exercising operations.

In accordance with one aspect of the invention, there is provided a multifunction exerciser comprising a base, a coupler including a first end rotatably attached to the base, to allow the coupler to be rotated relative to the base, and including a second end, a lever attached to the second end of the coupler, and including at least one seat disposed thereon, for supporting a user thereon, a handle device rotatably attached to the base, a link pivotally coupling the handle device to the coupler and thus to the lever, to allow the user to elevate himself and the lever by rotating the handle device relative to the base, a foot support rotatably attached to the base with a pivot pin, to allow the foot support to be rotated relative to the base with the pivot pin, the foot support including at least one foot pedal disposed thereon, to support the user, and a connecting rod pivotally coupled between the link and the foot support, to couple the foot support to the handle device and the coupler and the level.

The coupler includes a cavity formed in the second end thereof, for receiving the lever, and includes a latch for securing the lever to the coupler. The lever include a post disposed thereon and having a seat disposed thereon, for supporting the user.

The handle device includes a pair of hand grips, and a connecting bar coupled between the hand grips, and a connector extended from the connecting bar and having a free end rotatably coupled to the base with a pivot shaft.

The base includes a pair of beams to form a channel between the beams, and a bracket secured between the beams and having a space formed therein and communicating with the channel of the base, the free end of the connector of the handle device is engaged into the space of the bracket and rotatably coupled to the bracket of the base with a pivot shaft.

The base includes a cushioning member disposed on the bracket, for engaging with and for cushioning the lever, and for preventing the lever from heavily striking or impacting onto the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
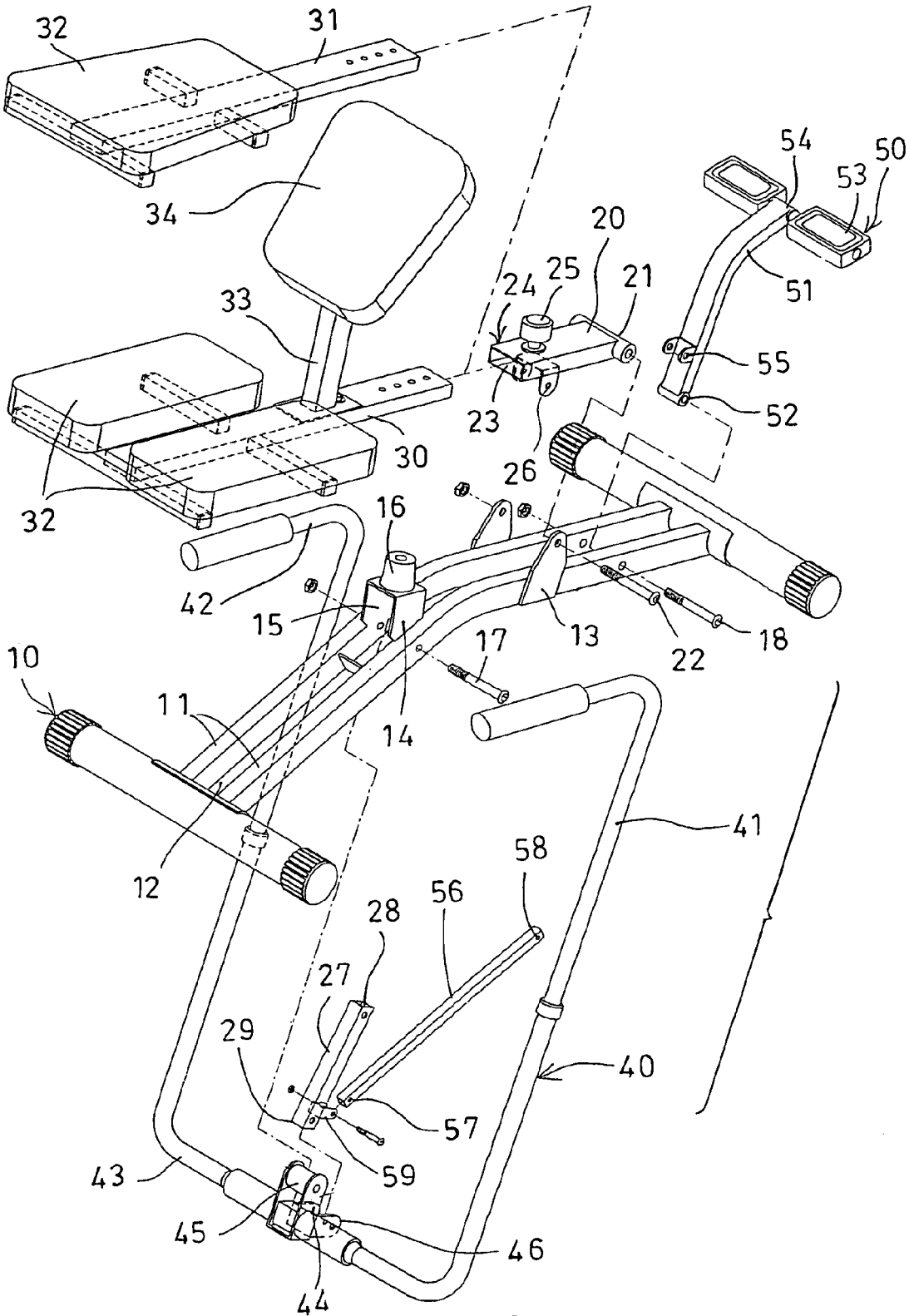
FIG. 1 is an exploded view of a multifunction exerciser in accordance with the present invention.
Figure 2:
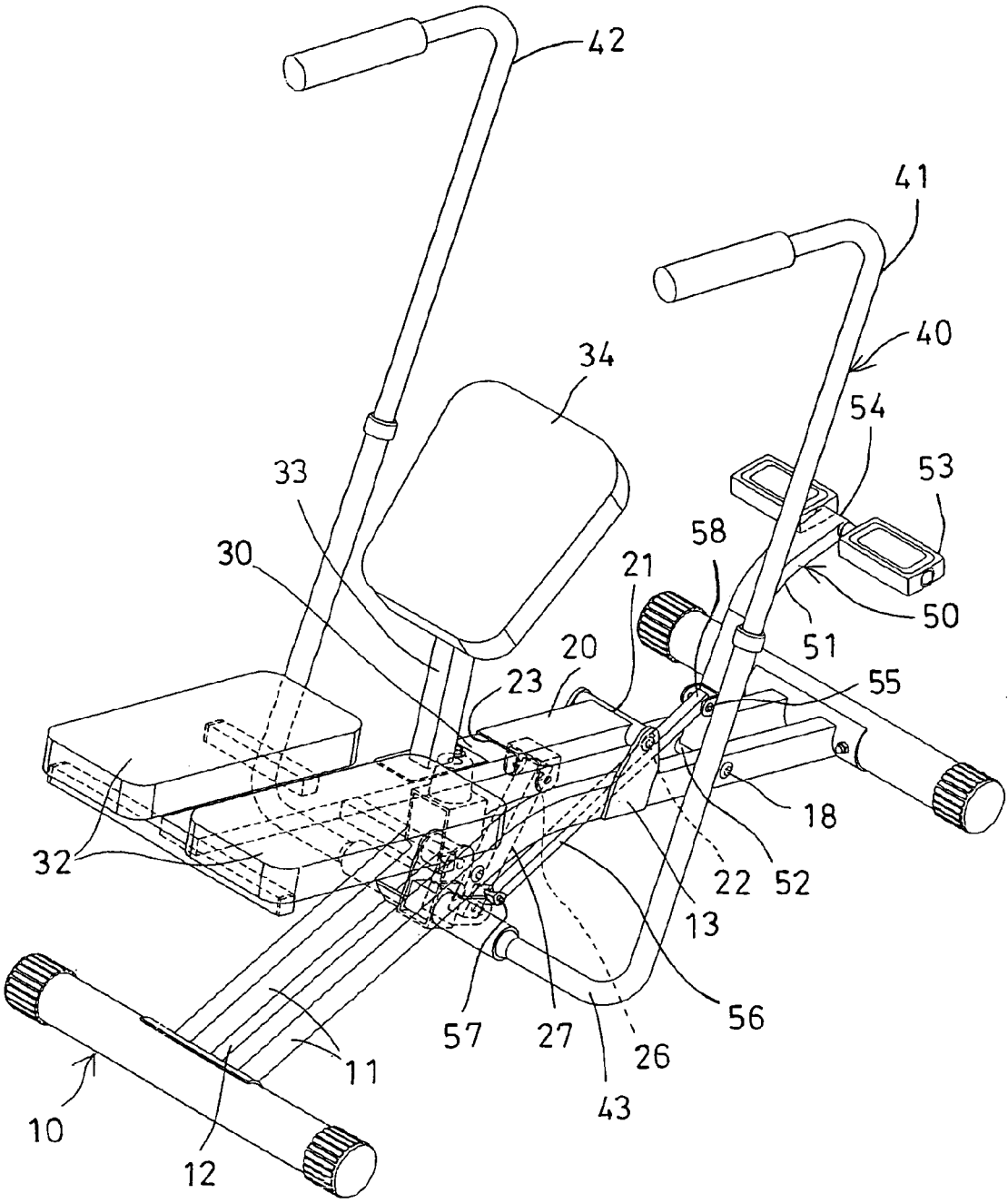
FIG. 2 is a perspective view of the multifunction exerciser.
Figure 3:
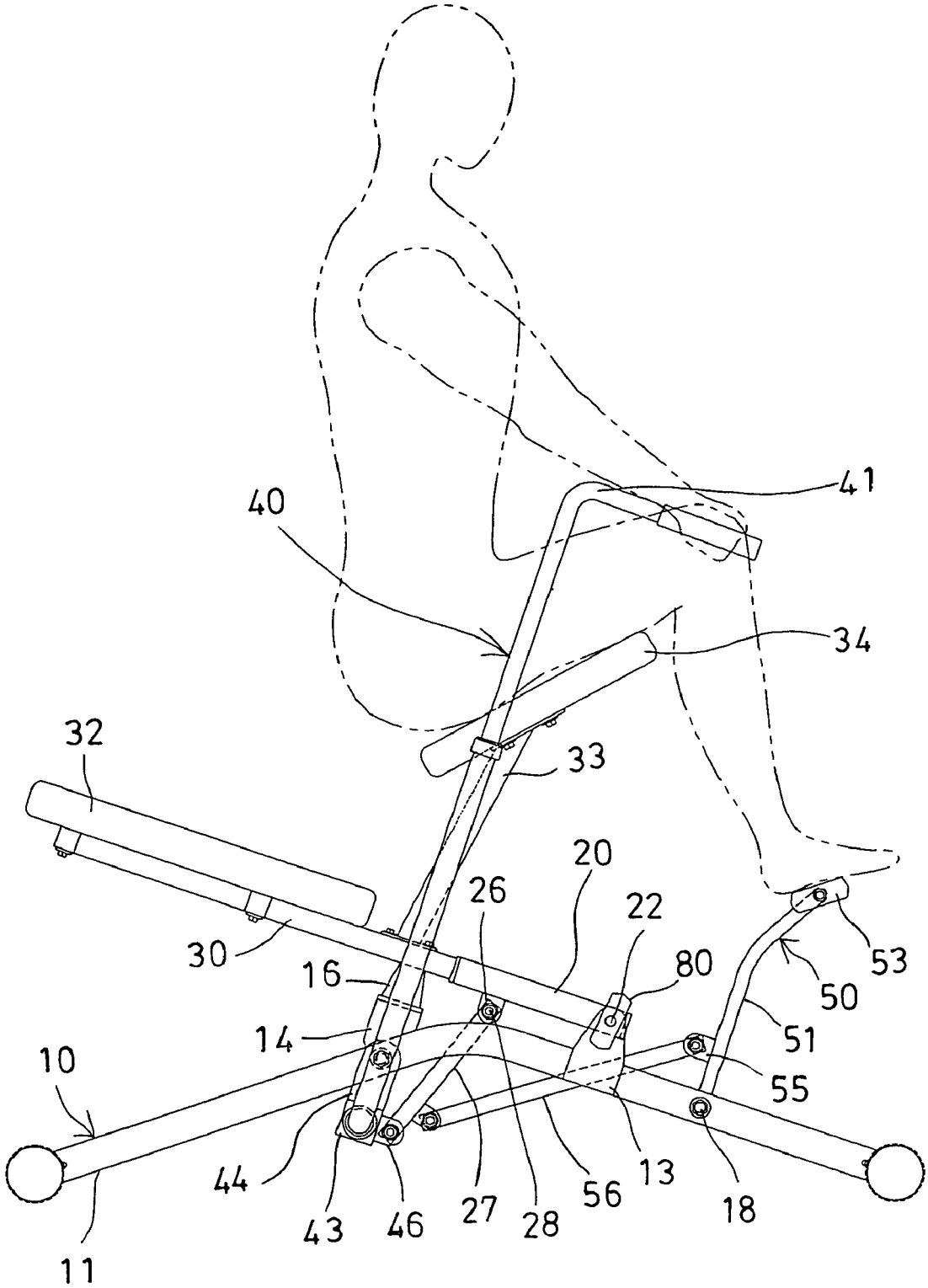
FIG. 3 is a side elevational view of the multifunction exerciser.

Referring to the drawings, and initially to FIGS. 1–3, a multifunction exerciser in accordance with the present invention comprises a base 10 including a pair of upwardly curved or protruding beams 11 that are disposed or arranged parallel to each other, to form or define a channel 12 between the beams 11, and including one or more, such as two protrusions 13 extended upwardly therefrom, such as extended upwardly from the beams 11 thereof respectively.

A coupler 20 includes a first end 21 rotatably or pivotally attached or secured to the base 10, such as to the protrusions 13 of the beams 11 with a pivot axle 22, to allow the coupler 20 to be rotated relative to the base 10, and includes a cavity 23 formed in the other end 24 thereof, for selectively receiving or securing either of the levers 30 (FIGS. 1–7), 31 (FIGS. 1 and 8–11), and includes a lock or latch 25 for adjustably securing the levers 30, 31 to the coupler 20, and includes a bracket 26 for rotatably or pivotally coupling to one end 28 of a link 27.

The levers 30, 31 may each include one or more pads or seats 32 disposed thereon, for supporting the users, such as the knees of the users (FIGS. 5–7), or the buttocks or the bottom portions of the users (FIGS. 3–4 and 8–11). The lever 30 may further include a post 33 disposed thereon or extended therefrom and having another pad or seat 34 attached thereto or disposed thereon, for supporting the back portions of the users, or for supporting the buttocks or the bottom portions of the users (FIGS. 3–6).

The base 10 includes a bracket 14 disposed thereon, such as disposed or provided on the middle portion of the beams 11, and secured between the beams 11, and having a space 15 formed therein and communicating with the channel 12 of the base 10, and includes a pad or cushioning member 16 disposed on the bracket 14 thereof, for engaging with and for cushioning the levers 30, 31 (FIGS. 3, 5, 8, 10), and for preventing the levers 30, 31 from being heavily impacting onto the beams 11 of the base 10.

A handle device 40 includes a pair of handle members or hand grips 41, 42, and a connecting bar 43 coupled between the hand grips 41, 42, and an extension or connector 44 extended upwardly from the connecting bar 43 and having an upper or free end 45 engaged into the space 15 of the bracket 14 and rotatably or pivotally coupled to the bracket 14 or the beams 11 of the base 10 with such as a pivot shaft 17, to allow the handle device 40 to be pivoted or rotated relative to the bracket 14 and the beams 11 of the base 10 about or with the pivot shaft 17.

The handle device 40 further includes another bracket 46 attached to or extended from the connector 44 or directly extended from the connecting bar 43, for rotatably or pivotally coupling to the other end 29 of the link 27, and thus for pivotally coupling the handle device 40 to the coupler 20 and thus to the levers 30, 31 respectively, to allow the users to elevate themselves and the levers 30, 31 by rotating the handle device 40 relative to the beams 11 of the base 10.

A foot support 50 includes a pole 51 having a lower end 52 rotatably or pivotally coupled to the beams 11 of the base 10 with such as a pivot pin 18, to allow the foot support 50 to be pivoted or rotated relative to the beams 11 of the base 10 about or with the pivot pin 18. The foot support 50 further includes one or more, such as two foot pedals 53 attached to or disposed on the upper portion 54 of the pole 51, and includes a further bracket 55 attached to or extended from the middle portion of the pole 51.

A connecting rod 56 is rotatably or pivotally coupled between the link 27 and the pole 51 of the foot support 50, and includes two ends 57, 58 rotatably or pivotally coupled to the bracket 59 of the link 27 and to the bracket 55 of the foot support 50, and thus to couple the foot support 50 to the handle device 40 and the coupler 20 and thus to the levers 30, 31, to allow the users to elevate themselves and the levers 30, 31 by stepping and rotating the foot support 50 relative to the beams 11 of the base 10 and/or selectively by rotating the handle device 40 relative to the beams 11 of the base 10 (FIGS. 3–4 and 8–11).

As shown in FIGS. 3–7, one or more, such as two further foot pedals 80 may further be provided and attached to or disposed on the protrusions 13 of the beams 11 or of the base 10, or secured to the pivot axle 22, to allow the users to step on the foot pedals 80, and to allow the users to position or to anchor the feet of the users, when required.

Figure 4:
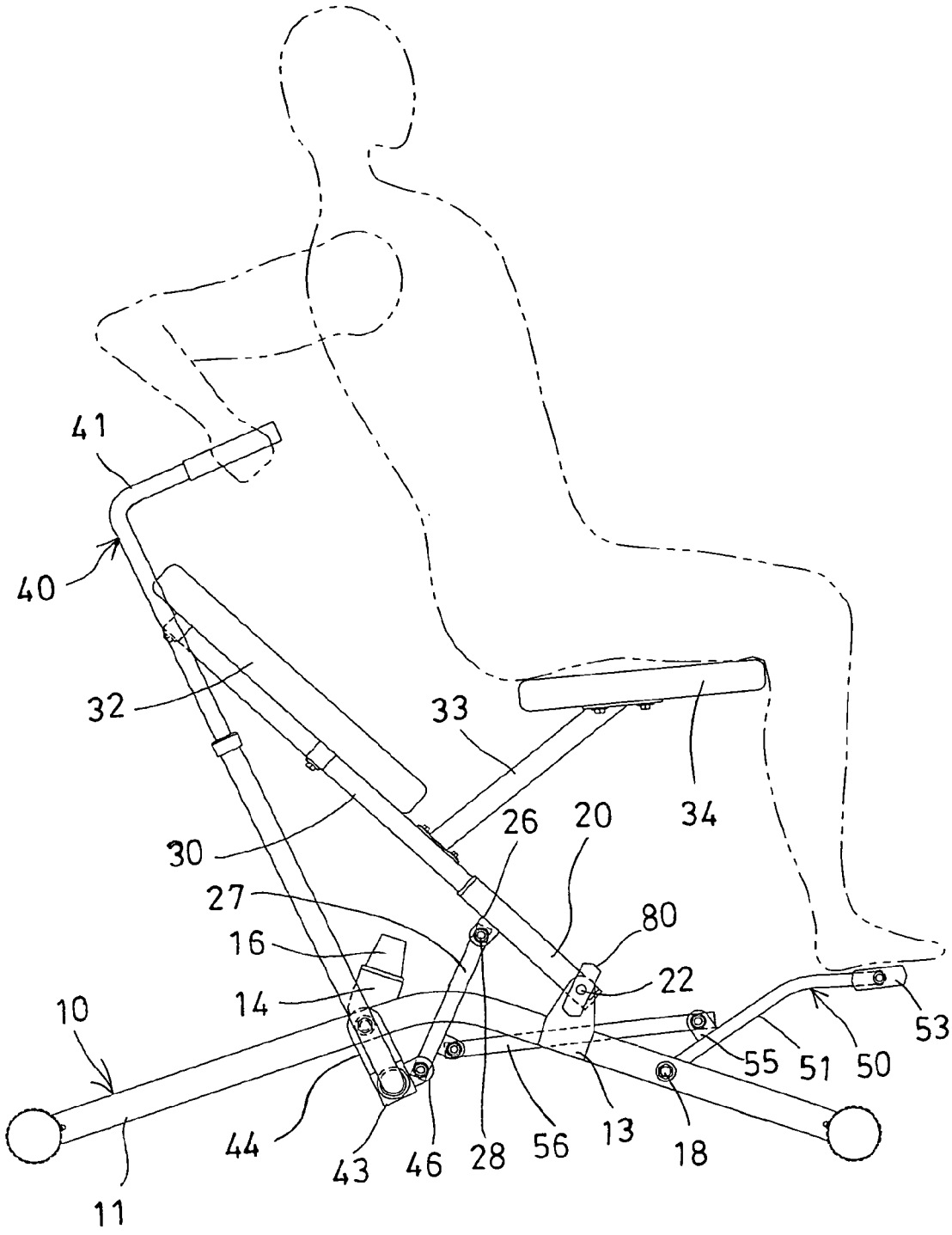
FIG. 4 is a side elevational view similar to FIG. 3, illustrating the operation of the multifunction exerciser.
Figure 5:
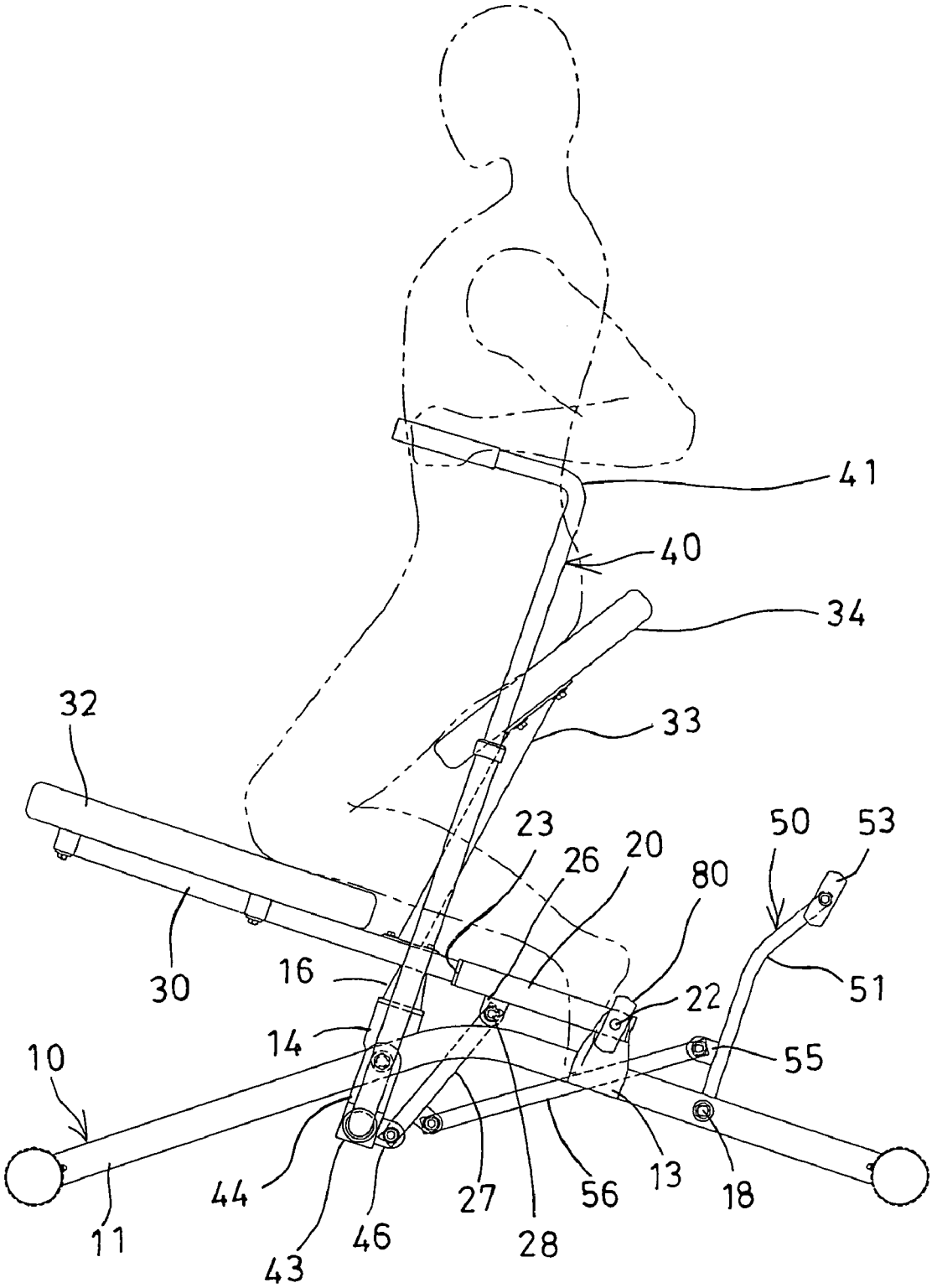
FIGS. 5, 6, 7 are side elevational views similar to FIGS. 3 and 4, illustrating the other operation mode of the multifunction exerciser.
Figure 6:
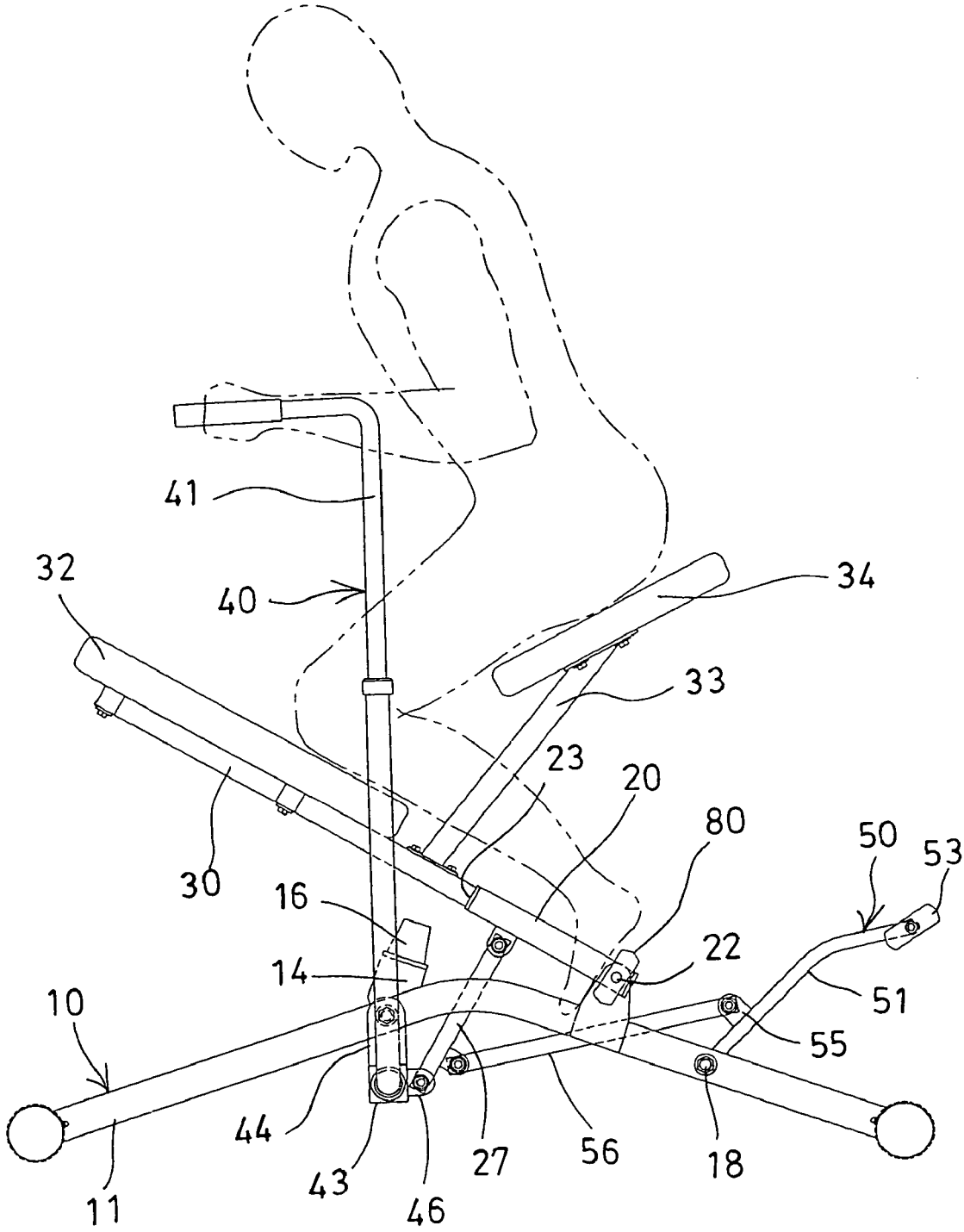
Figure 7:
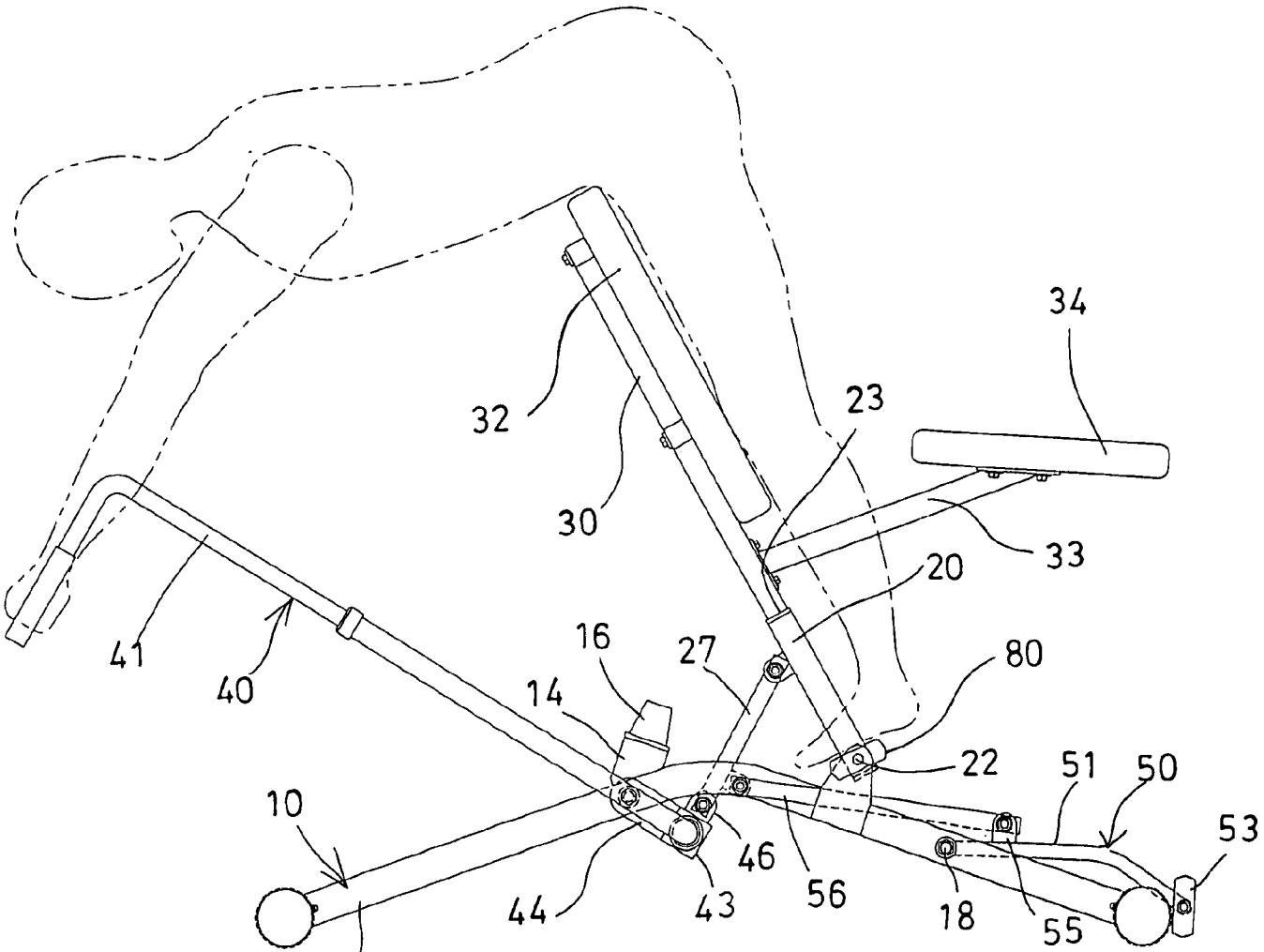

In operation, as shown in FIGS. 3 and 4, the user may sit on the seat 34 of the lever 30, and may step on the foot pedals 53, to allow the user to elevate the lever 30 against his own weight by stepping and rotating the foot support 50 relative to the beams 11 of the base 10 and/or selectively by rotating the handle device 40 relative to the beams 11 of the base 10. As shown in FIGS. 5–7, the user may knee on the seat 32 of the lever 30, and may step on the foot pedals 80, to allow the user to elevate the lever 30 against his own weight by rotating the handle device 40 relative to the beams 11 of the base 10.

Figure 8:
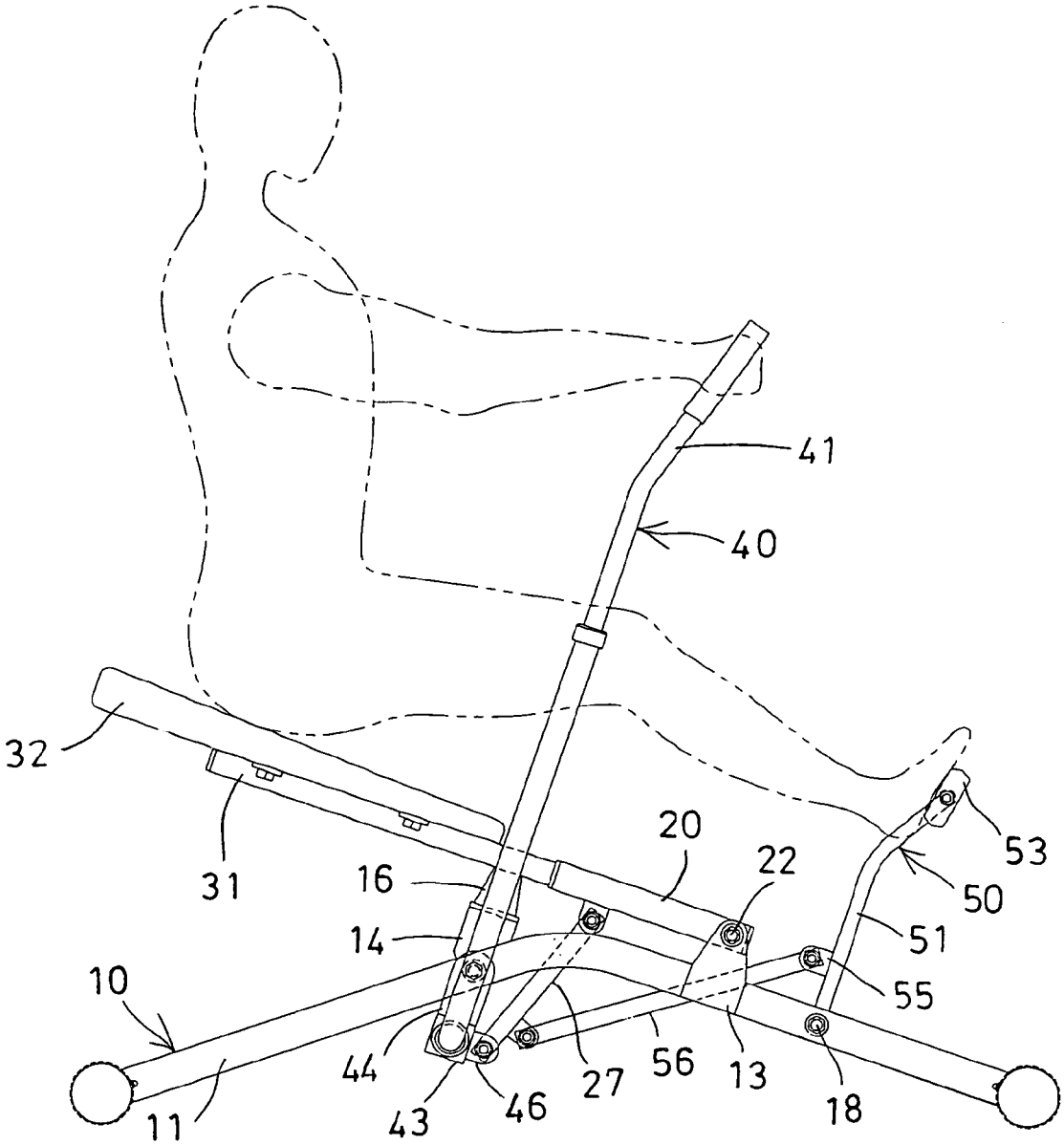
FIGS. 8, 9 are side elevational views similar to FIGS. 3–4 and 5–7, illustrating the further operation mode of the multifunction exerciser.
Figure 9:
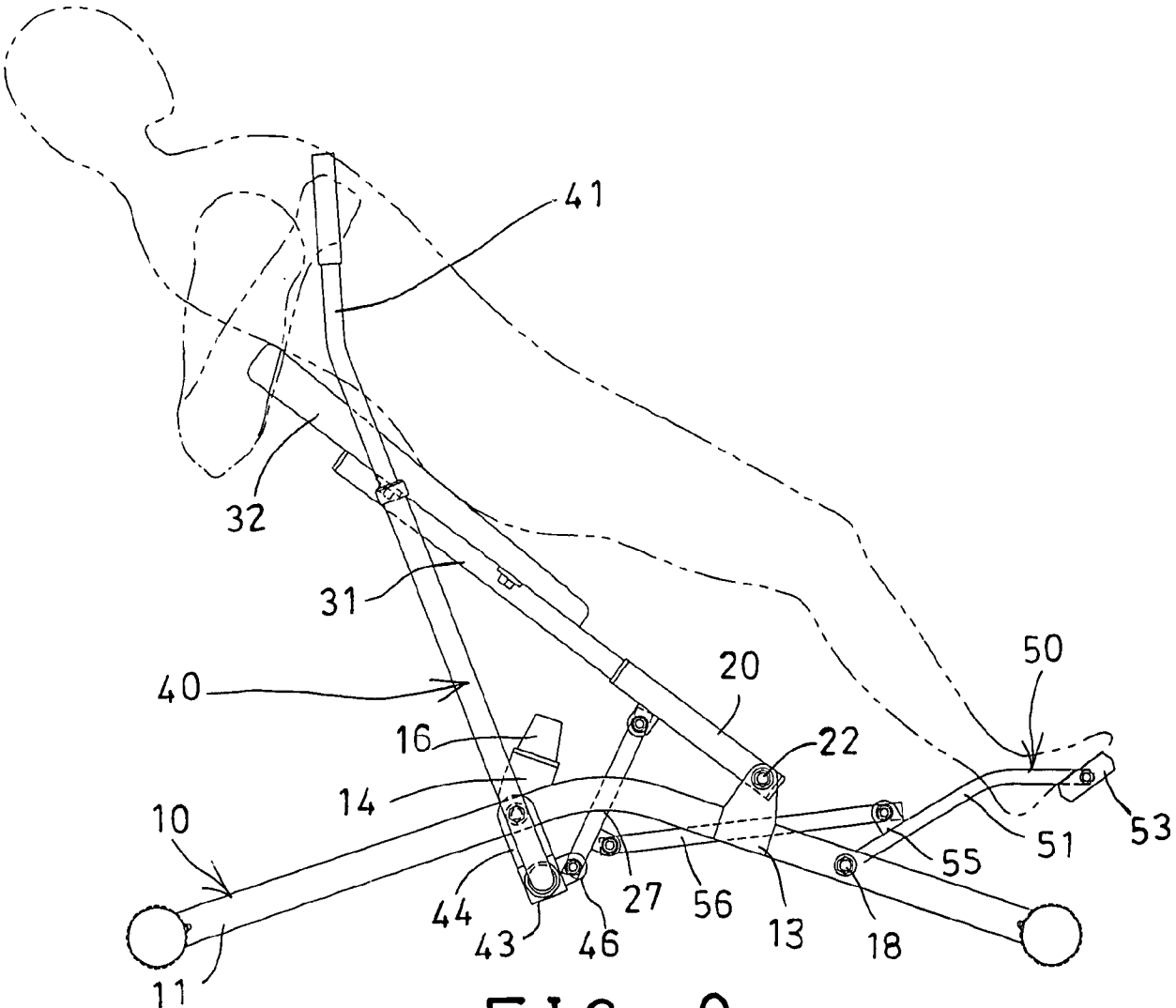
Figure 10:
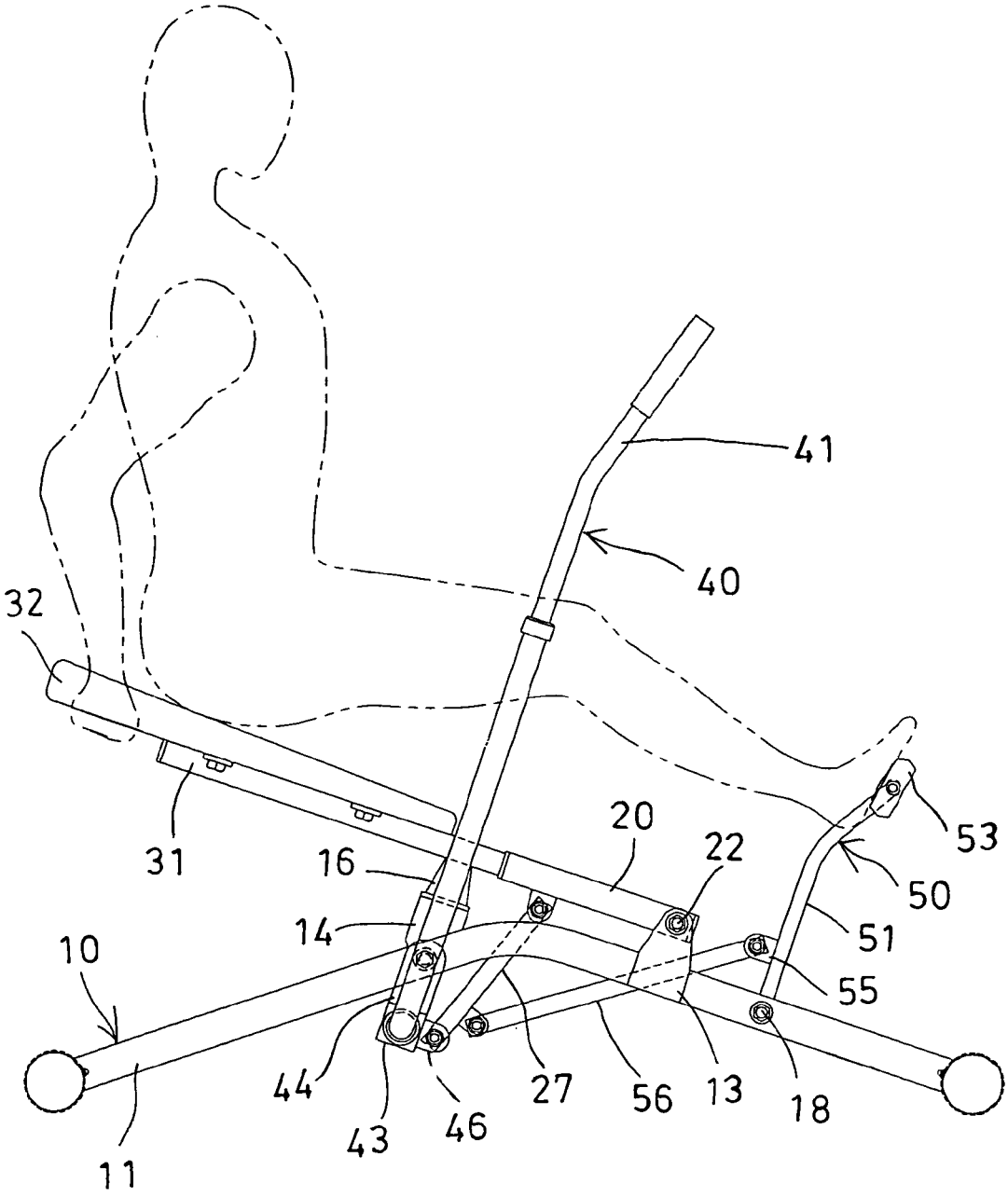
FIGS. 10, 11 are side elevational views similar to FIGS. 3–4, 5–7 and 8–9, illustrating the still further operation mode of the multifunction exerciser.
Figure 11:
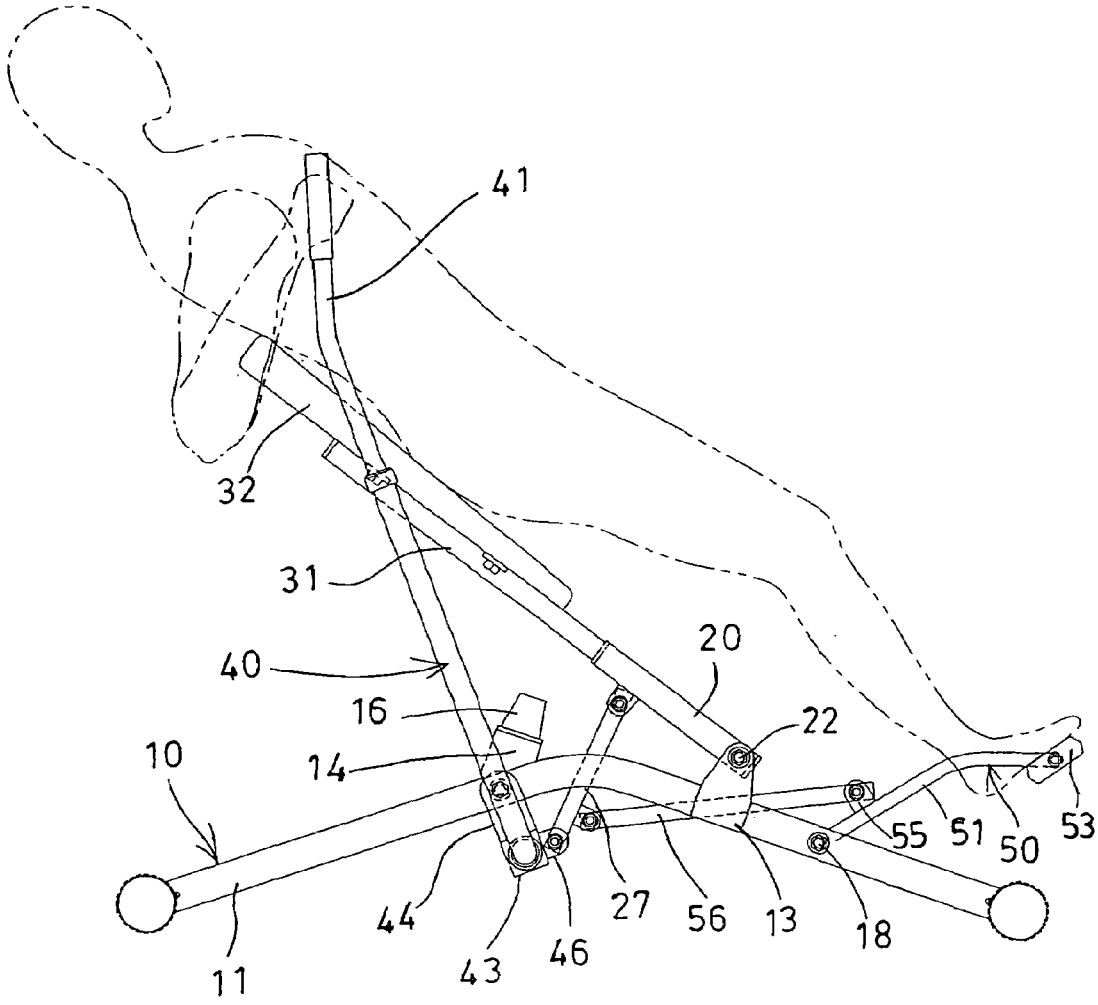

Alternatively, as shown in FIGS. 8–9, the user may sit on the seat 32 of the other lever 31, and may step on the foot pedals 53, to allow the user to elevate the lever 31 against his own weight by stepping and rotating the foot support 50 relative to the beams 11 of the base 10 and/or selectively by rotating the handle device 40 relative to the beams 11 of the base 10. As shown in FIGS. 10–11, the user may sit on the seat 32 of the other lever 31, and may step on the foot pedals 53, and may grasp the seat 32, to allow the user to rotate and to elevate the lever 31 against his own weight by stepping and rotating the foot support 50 relative to the beams 11 of the base 10.

Accordingly, the multifunction exerciser in accordance with the present invention may be used for providing various kinds of operating modes and for allowing the users to conduct various kinds of exercising operations.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A multifunction exerciser comprising:

a base, a coupler including a first end rotatably attached to said base, to allow said coupler to be rotated relative to said base, and including a second end, a lever attached to said second end of said coupler, and including at least one seat disposed thereon, for supporting a user thereon, a handle device rotatably attached to said base, a link pivotally coupling said handle device to said coupler and thus to said lever, to allow the user to elevate himself and said lever by rotating said handle device relative to said base, a foot support rotatably attached to said base with a pivot pin, to allow said foot support to be rotated relative to said base with said pivot pin, said foot support including at least one foot pedal disposed thereon, to support the user, and a connecting rod pivotally coupled between said link and said foot support, to couple said foot support to said handle device and said coupler and said level.

2. The multifunction exerciser as claimed in claim 1, wherein said coupler includes a cavity formed in said second end thereof, for receiving said lever, and includes a latch for securing said lever to said coupler.

3. The multifunction exerciser as claimed in claim 1, wherein said lever include a post disposed thereon and having a seat disposed thereon, for supporting the user.

4. The multifunction exerciser as claimed in claim 1, wherein said handle device includes a pair of hand grips, and a connecting bar coupled between said hand grips, and a connector extended from said connecting bar and having a free end rotatably coupled to said base with a pivot shaft.

5. The multifunction exerciser as claimed in claim 4, wherein said base includes a pair of beams to form a channel between said beams, and a bracket secured between said beams and having a space formed therein and communicating with said channel of said base, said free end of said connector of said handle device is engaged into said space of said bracket and rotatably coupled to said bracket of said base with a pivot shaft.

6. The multifunction exerciser as claimed in claim 5, wherein said base includes a cushioning member disposed on said bracket, for engaging with and for cushioning said lever, and for preventing said lever from being heavily impacting onto said base.

* * * * *